United States Patent [19]

Ito

[11] Patent Number: 5,043,727

[45] Date of Patent: Aug. 27, 1991

[54] DISPLAY SYSTEM FOR MARINE VESSEL

[75] Inventor: Saburo Ito, Hamamatsu, Japan

[73] Assignee: Sanshin Kogyo Kabushiki Kaisha, Hamamatsu, Japan

[21] Appl. No.: 473,223

[22] Filed: Jan. 31, 1990

[30] Foreign Application Priority Data

Feb. 3, 1989 [JP] Japan ..... 1-25490
Feb. 3, 1989 [JP] Japan ..... 1-25491

[51] Int. Cl.[5] ..... G08B 23/00

[52] U.S. Cl. ..... 340/984; 340/438; 340/461; 364/424.03; 367/111; 440/2

[58] Field of Search ..... 340/984, 987, 461, 438, 340/459, 480, 973; 367/107, 110, 111; 440/2; 364/424.01, 424.03

[56] References Cited

U.S. PATENT DOCUMENTS

| | | | |
|---|---|---|---|
| 4,296,409 | 10/1981 | Whitaker et al. | 340/459 |
| 4,419,654 | 12/1983 | Funk | 340/438 |
| 4,555,964 | 11/1985 | Yanagishima et al. | 340/461 |
| 4,646,059 | 2/1987 | Iwamoto et al. | 340/461 |
| 4,652,878 | 3/1987 | Borgersen | 340/984 |
| 4,837,750 | 6/1989 | Saunders | 367/111 |

*Primary Examiner*—Joseph A. Orsino
*Assistant Examiner*—Brent A. Swarthout
*Attorney, Agent, or Firm*—Ernest A. Beutler

[57] ABSTRACT

A first embodiment of the invention provides a display system which is adapted to be embodied in a marine vessel having marine propulsion unit which is pivotally attached thereto for trim movement about a generally horizontally extending trim axis. The display system includes a trim angle sensor for detecting the trim angle of the propulsion unit and a trim angle display, preferably including both a graphical and a digital display, for precisely displaying information regarding the detected trim angle of the propuslion unit. Other sensors for detecting various other operating and navigating conditions of the vessel can be incorporated into the display system and a single displaying device can be used for displaying trim angle information and information regarding such other detected conditions. Another embodiment of the invention provides a display system which is adapted to be embodied in a marine vessel having a marine propulsion unit including an engine. This display system includes a cumulative engine operating time sensor, preferably in the form of a charge or pulser coil, other sensors for detecting various other operating and navigating conditions of the vessel, and a single displaying device for displaying the cumulative engine operating time and information regarding at least one of the aforementioned other detected conditions.

8 Claims, 9 Drawing Sheets

DISPLAY SYSTEM FOR MARINE VESSEL

BACKGROUND OF THE INVENTION

The invention relates to a display system for a marine vessel having a marine propulsion unit which includes an engine. More particularly, the invention relates to a display system which displays information concerning the detected trim angle and cumulative engine operating time which can also be embodied in a larger, more elaborate display system which displays information regarding other operating and navigating conditions of the vessel. The larger display system can also display information regarding the detection of fish.

For reaching and maintaining maximum vessel speed or for operating the vessel under conditions which optimize efficiency, the trim angle of the marine propulsion unit should be adjusted in response to the running conditions of the vessel. It is, therefore, desirable for the vessel operator to be kept informed of the current trim angle of the propulsion unit so that it can be adjusted accordingly.

It is also desirable for the vessel operator or owner to know the cumulative operating time of the engine of the marine propulsion unit for warranty purposes and engine maintenance purposes, and for this operating time to be displayed on a single displaying device together with information concerning other operating and navigating conditions of the vessel.

However, previous displays in marine vessels display operating and navigating information such as engine and vessel speed, and cumulative engine operating time on separately installed panels or display devices. As a result, it is difficult for the operator simultaneously to view all of the information displayed on these panels or devices. Such displays also make it difficult for the operator to promptly recognize and cope with any abnormality regarding any of the conditions being displayed on the panel or device other than the one currently being watched.

It is, therefore an object of this invention to detect and to precisely display information concerning the trim angle of a marine propulsion unit attached to an associated marine vessel so as to improve operability of the vessel.

It is another object of this invention to centrally control information regarding various operating and navigating conditions of a marine vessel including cumulative engine operating time and to display such information on a single displaying device.

A further object of this invention is to improve the visibility of displayed information concerning the various operating and navigating conditions including cumulative engine operating time.

Yet another object of this invention is to improve the safety of operating the vessel by displaying information on operating and navigating conditions along with cumulative engine operating time on a single displaying device so the operator can easily and promptly recognize and cope with any abnormality regarding the conditions being displayed.

SUMMARY OF THE INVENTION

A first embodiment of the invention includes a display system which is adapted to be embodied in a marine vessel having a marine propulsion unit pivotally attached thereto for trim movement about a generally horizontally extending trim axis. The display system includes means for detecting the trim angle of the propulsion unit and a trim angle display, preferably including both a graphical and a digital display, for precisely displaying information regarding the detected trim angle of the marine propulsion unit. The display system can further include various means for detecting various other operating and navigating conditions and a single displaying device for displaying trim angle information and information regarding such other detected conditions.

Another embodiment of the invention comprises a display system adapted to be embodied in a marine vessel having a marine propulsion unit including an engine. This display system includes means for detecting the cumulative engine operating time, means for detecting various other operating and navigating conditions, and a single displaying device for displaying the cumulative engine operating time and information regarding one or more of the aforementioned other detected conditions.

The single displaying device can include a fixed display for displaying frequently watched information regarding particular operating and navigating conditions. Such information typically includes fuel level, engine speed, vessel speed, cumulative engine operating time and time. The single displaying device can also include a variable display which has three displays: a first display of information, a second display of information, and a warning display of warning information. The first display typically displays information concerning oil level, engine cooling water temperature, battery voltage, trim angle of the propulsion unit and water depth. The second display typically displays information regarding fish detection, water temperature, vessel direction and vessel position. The warning display preferably displays warning information regarding fuel level, oil level, engine cooling water temperature, battery voltage, trim angle and water depth. When one or more of these latter conditions are detected to be outside of a predetermined range for that particular condition, the warning display displays a flashing warning signal for that particular condition.

DETAILED DESCRIPTION OF THE PREFERRED EMBODIMENTS

Figure 1:
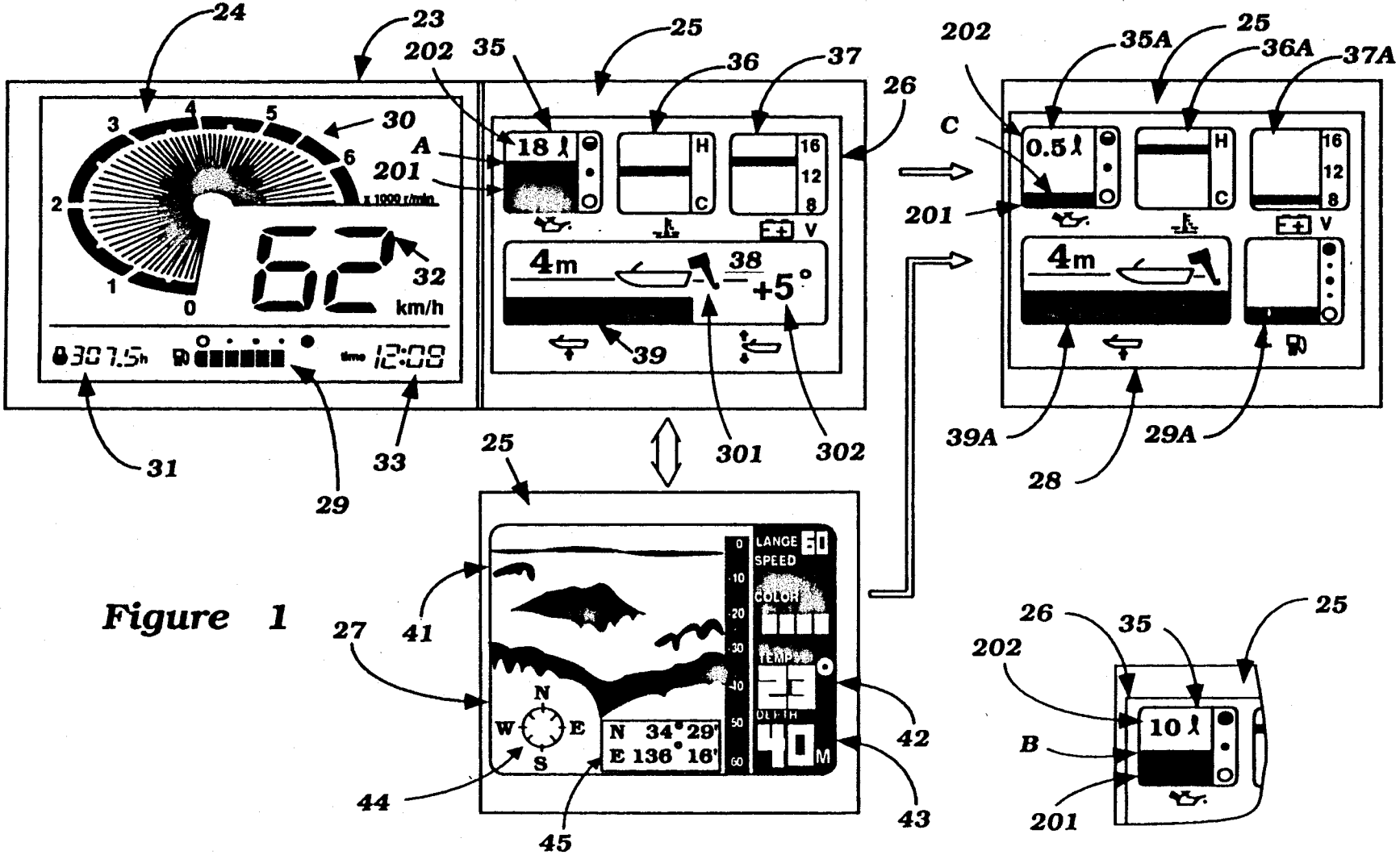
FIG. 1 is a schematic illustration showing an embodiment of the displaying device, including the fixed and variable displays, according to an embodiment of the present invention.
Figure 2:
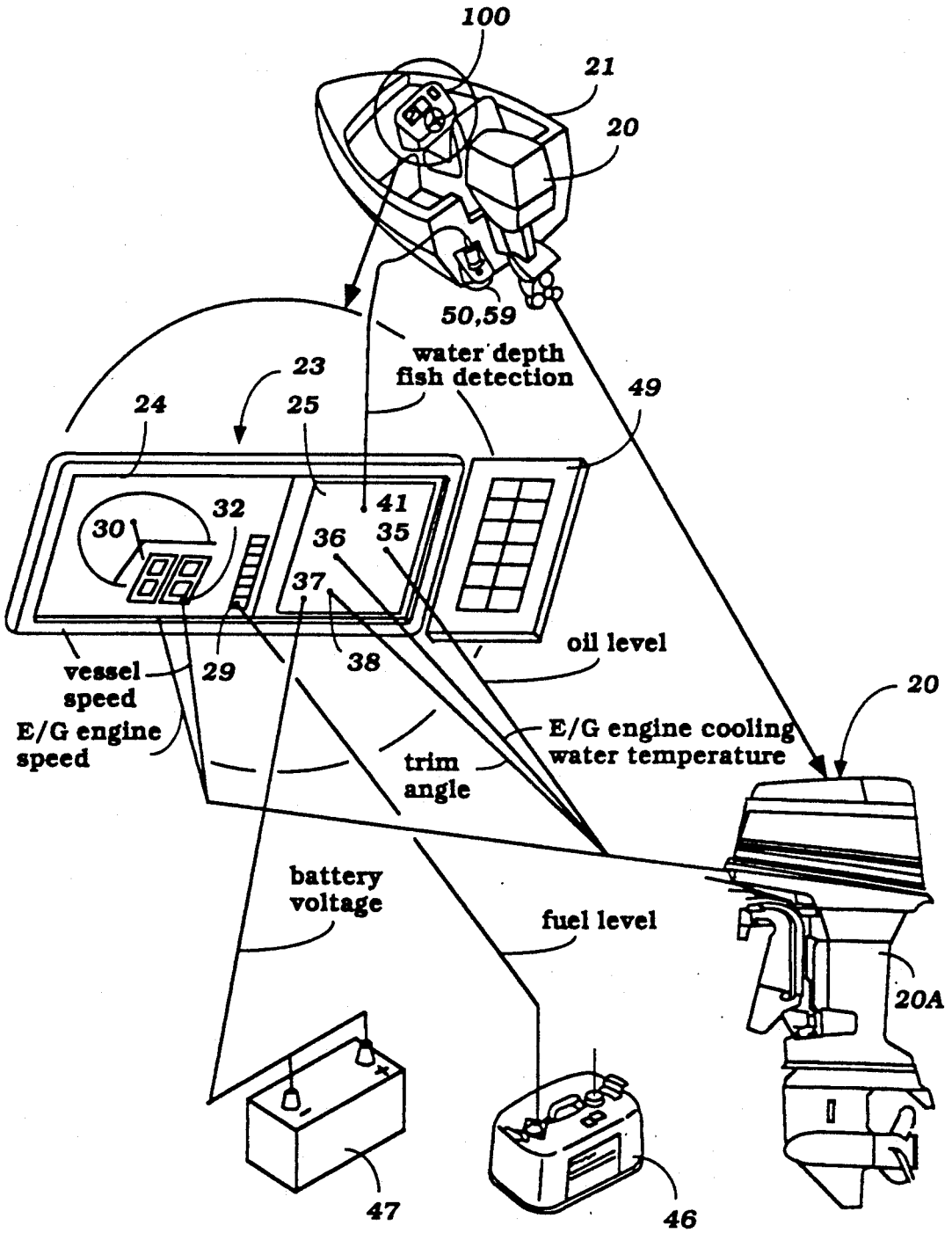
FIG. 2 is a schematic illustration of an arrangement and construction of the display system in combination with a vessel.

FIG. 1 shows a single displaying device 23 of a display system 22 for use in a marine vessel 21 (see FIG. 2) having a marine propulsion unit 20 (see FIG. 2). The marine propulsion unit 20 includes an engine, a drive-shaft housing 20A and a lower unit including propelling means for propelling the vessel 21 through the water. This displaying device 23 comprises a fixed display 24, preferably of the liquid crystal display (LCD) type, and a variable display 25 preferably of the cathode ray tube (CRT) type. The variable display 25 has three different displays: a first display of information, indicated generally by reference numeral 26, a second display of information 27, and a warning display of warning information indicated by numeral 28.

In the preferred embodiment, the fixed display 24 constantly displays information typically watched frequently by the operator during the operation of the vessel 21. This information includes fuel level 29, engine speed 30, usually indicated in revolutions per minute (RPM), cumulative engine operating time (display) 31, vessel speed 32, and time displayed on a clock 33.

The variable display 25, on the other hand, alternately displays three groups of information: first, second and warning displays of information 26, 27 or 28. First and second displays of information 26 and 27 are usually of the type not so frequently watched. In the preferred embodiment, the first display 26 includes information regarding oil level or an oil level display 35, engine cooling water temperature 36, battery voltage 37, trim angle of the propulsion unit 38 and water depth 39. The information regarding oil level (oil level display) 35 includes a graphical display 201 and a digital display 202. Examples of different oil levels illustrated graphically are indicated by the letters A, B, and C, along with their corresponding digital values in FIG. 1. The information regarding trim angle of the propulsion unit or trim angle display 38 also includes a graphical display 301 and a digital display 302. Alternatively, an oil level display and/or trim angle display can be separately installed and used for displaying information regarding oil level and trim angle respectively, and can include the aforementioned graphical and digital displays.

The second display 27 includes information regarding the detection of fish 41, water temperature 42 and water depth 43. The second display 27 also includes information concerning vessel direction 44 and vessel position 45. Information regarding fish detection 41 includes the presence or absence of fish and may include relative location of the fish.

The warning display 28 includes a fuel level warning 29A, an oil level warning 35A, an engine cooling water temperature warning 36A, a battery voltage warning 37A and water depth warning 39A. At least one of these warnings is automatically displayed on the warning display 28 of the variable display 25 when the condition relating to that warning is detected to be outside of a predetermined range 66 (see FIG. 3) for that particular condition. In the preferred embodiment, the warning or warnings are flashingly displayed and may be accompanied by a warning buzzer sound.

FIG. 2 schematically shows an arrangement of the display system 22. In FIG. 2, the display system 22 further includes a mode switch or key 49 for alternately displaying the first or second displays of information 26 or 27 when no warning information is being displayed. By depressing the mode switch 49, the operator can change the variable display 25 from the first display of information 26 to the second display of information 27 and vice versa. In the preferred embodiment, the displaying device 23 and mode switch 49 are positioned adjacent to one another on the dash board of the marine vessel 21.

In this embodiment, a main display indicated generally by reference numeral 100, is positioned in front of the driver's seat on the dashboard. This main display 100 configuration includes the single displaying device 23, the mode switch 49 and a control device 63 (see FIG. 3).

The display system 22 further includes a fish detection sensor 50 which may also act as a water depth sensor 59 affixed to the transom of the marine vessel 21, preferably on either side of the propulsion unit 20. As schematically illustrated in FIGS. 1 and 2, the fish detection sensor 50 detects the presence or absence of fish below or near the marine vessel 21 and may also detect the water depth. This information is then transmitted to a control device 63 (see FIG. 3) and ultimately to the displaying device 23 where the fish detection information 41 and water depth information 43 appear on the variable display 25 as part of the second display of information 27.

The display of information regarding various operating and navigating conditions is also illustrated schematically in FIG. 2. A fuel level sensor 51 on the fuel tank 46 senses the level of fuel in the tank 46. In accordance with the invention, fuel level information 29 appears on the fixed display 24. In a like manner, a battery voltage sensor 54 senses the voltage of the battery 47 so that this information 37 can be displayed on the variable display 25. Sensors for the oil level 52, engine cooling water temperature 53, trim angle 55, engine speed 56 and vessel speed 57 are located on the marine propulsion unit 20. The information regarding these conditions is displayed on the displaying device 23.

Figure 3:
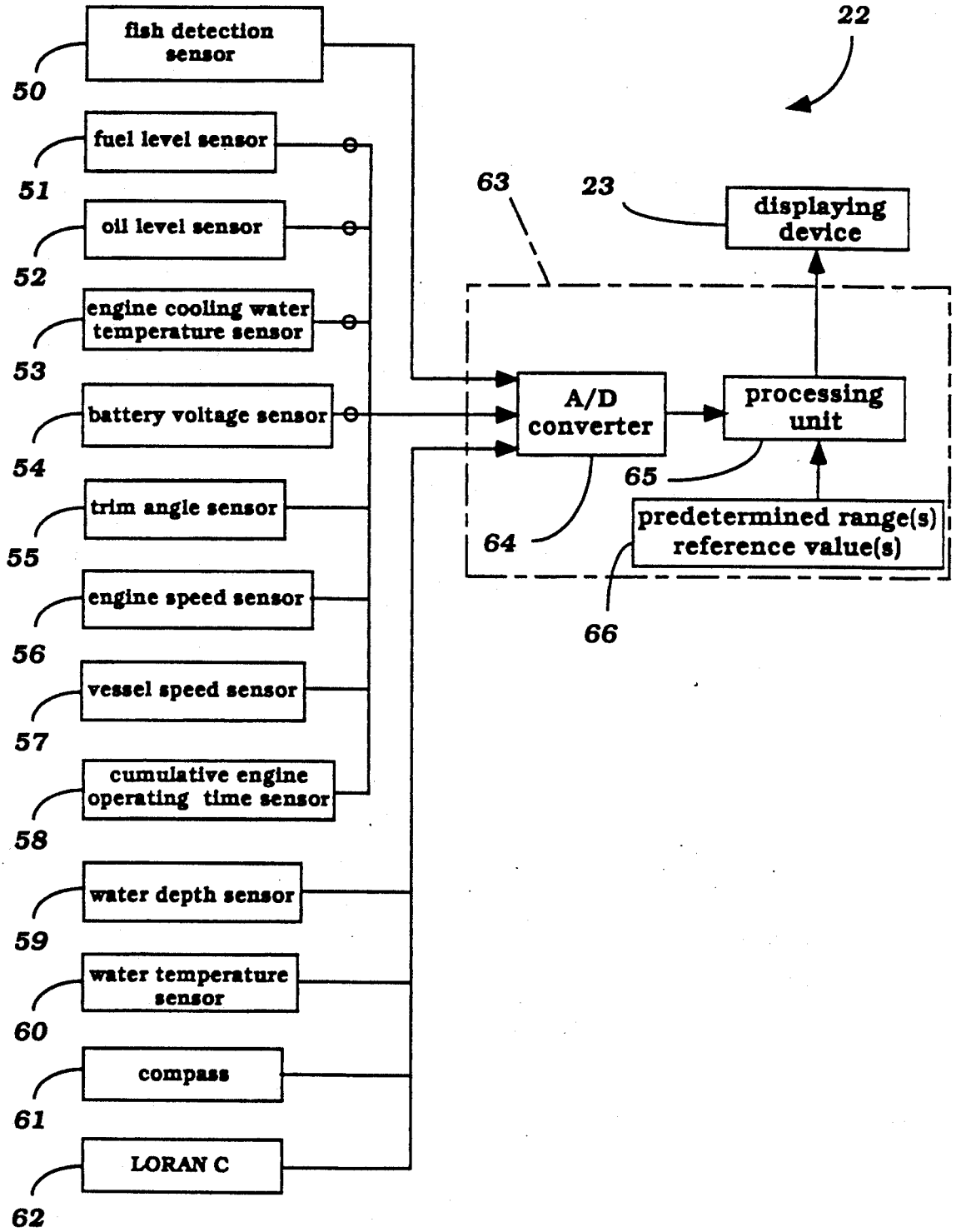
FIG. 3 is a block diagram showing an arrangement of the display system.

Referring now to FIG. 3, the display system 22 further includes a control device 63. This control device 63 includes an analog/digital (A/D) converter 64, a processing unit 65 and a predetermined range or ranges (reference value(s)) for one or more of the various operating and navigating conditions 66. In operation, the various means for detecting various operating and navigating conditions of the display system 22, such as the fish detection sensor 50, fuel level sensor 51, oil level sensor 52, engine cooling water temperature sensor 53, battery voltage sensor 54, trim angle sensor 55, engine speed sensor 56, vessel speed sensor 57, cumulative engine operating time sensor 58, water depth sensor 59 and water temperature sensor 60, compass 61 and long range navigational system (loran C) 62 input their signals to the control device 63. The processing unit 65 receives the output of the various sensors including the compass and loran C 50 - 62 through the A/D converter 64 and displays the sensor outputs as information on the displaying device 23. The processing unit 65 also receives output from the predetermined range or ranges for one or more of the various operating and navigating conditions 66. When a particular condition is detected to be outside of its predetermined range 66 stored in the control device 63, the processing unit 65 automatically displays on the variable display 25 of the displaying device 23 warning information regarding that particular condition.

Figure 4:
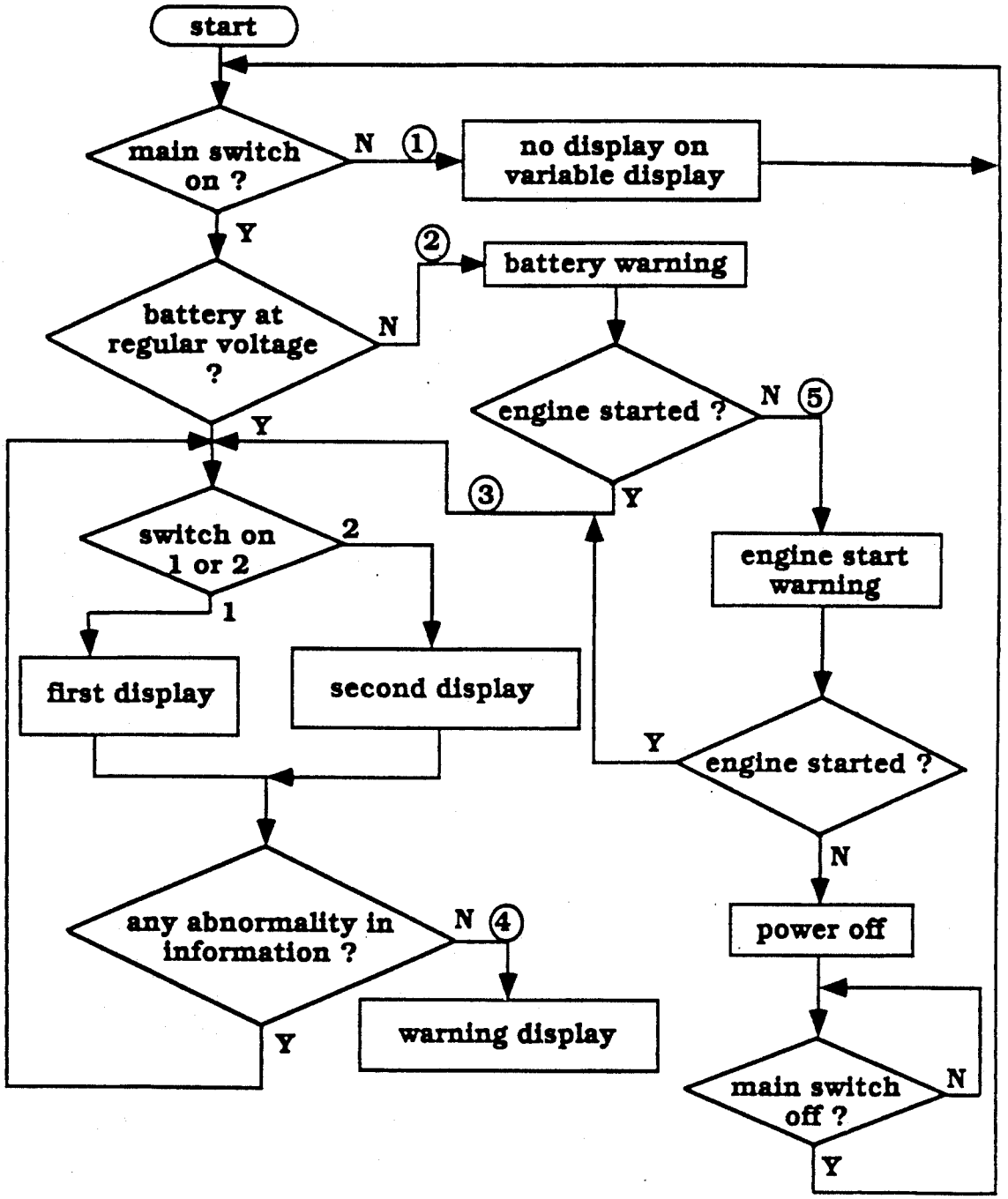
FIG. 4 is a flow chart showing an embodiment of the operation of the display system.

FIG. 4 shows an embodiment of the operation of the variable display 25 of the display system 22. If the main switch used to turn on the variable display 25 is off, there will be no display on the variable display 25 and the program repeats. If the main switch is on, the variable display 25 will appear on the displaying device 23. At that point, a determination is made as to whether the battery voltage 37 is as prescribed. If the battery voltage 37 is outside of its predetermined range 66, the battery voltage warning 37A appears on the variable display 25. The next juncture is controlled by whether or not the engine is started. If the engine is started, the operator may use the mode switch 49 for displaying either the first or second displays 26 or 27 of the variable display 25. By depressing the mode switch 49, the operator can change from the first display 26 to the second display 27 or vice versa. However, the operator's ability to change between the first and second displays 26 and 27 is subject to whether there is any abnormality in information regarding at least one of the various operating and navigating conditions of the vessel 21. If a particular condition is detected to be outside of its predetermined range, warning information regarding that condition is automatically, flashingly displayed on the variable display 25. This warning information is part of the warning display 28 and may be accompanied by a warning buzzer.

If no abnormalities are detected, the operator may continue to alternately display the first and second displays 26 and 27 by using the mode switch 49.

Referring back to the juncture controlled by whether the engine is started after the battery voltage warning 37A appears on the variable display 25, if the engine is not started, an engine start warning lights up on the dashboard of the marine vessel 21. If the engine remains unstarted at that point, the power is turned off. When the main switch is turned off, the program repeats.

If the engine is started following the battery voltage warning 37A, the program enters the junction where the operator may use the mode switch 49 to alternately display either the first or second displays 26 or 27. The program enters that same junction if the engine is started after the engine start warning appears.

Figure 5:
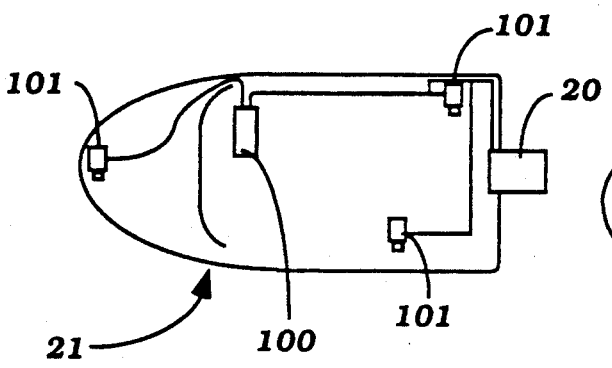
FIG. 5 is a schematic illustration showing an embodiment of the display system including sub-displays and an example of installation.

FIG. 5 illustrates an example of installation of the display system 22. In this embodiment, the main display 100, which includes the control device 63, is positioned in front of the driver's seat for viewing by the vessel driver. Sub-displays 101 which include the displaying device 23 but do not include the control device 63 are positioned in other locations in the marine vessel 21 to permit viewing of the displayed information in those locations as well. FIG. 5 shows three (3) sub-displays 101. One is positioned at the bow end of the marine vessel 21, another is positioned at the stern end of the vessel 21 on the starboard side and the third is positioned on the port side of the vessel 21. In this embodiment, information displayed on the displaying device 23 can be viewed at four (4) different locations within the marine vessel 21 for convenience of the operator and other individuals who may be aboard the vessel 21. The various detecting means or sensors 50–62 input their signals to the control device 63 of the main display 100. The control device 63 displays the sensor outputs as information on the main display 100 and on the sub-displays 101.

Figure 6:
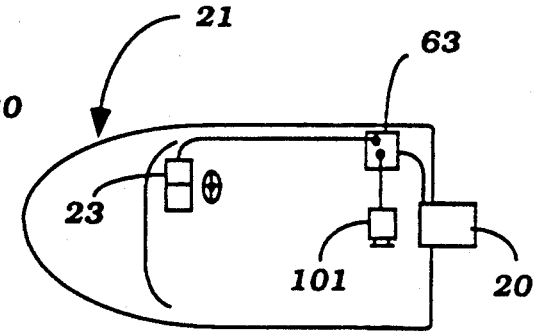
FIG. 6 is a schematic illustration showing another embodiment of the display system including a sub-display and an example of installation.

FIG. 6 shows another example of installation of the display system 22. In this embodiment, the displaying device 23 is positioned on the dashboard of the marine vessel 21 in front of the driver's seat while the control device 63 is located at the stern end of the vessel 21 on the starboard side. A sub-display 101 is positioned at the stern end of the vessel 21 in front of the marine propulsion unit 20. In this arrangement, the control device 63 receives the sensor outputs and displays them as information on both the displaying device 23 and the sub-display 101.

Figure 7:
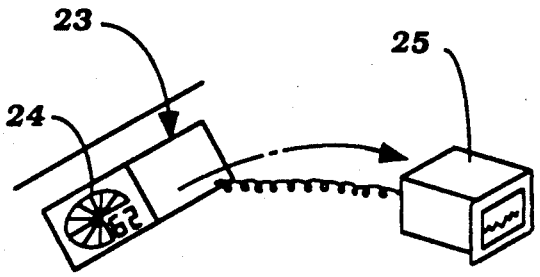
FIG. 7 is a schematic representation showing a modification of a display system.

FIG. 7 schematically illustrates a modification of the display system 22. In this embodiment, the variable display 25 can be located adjacent to the fixed display 24 or in a different position within the marine vessel 21.

Figure 8:
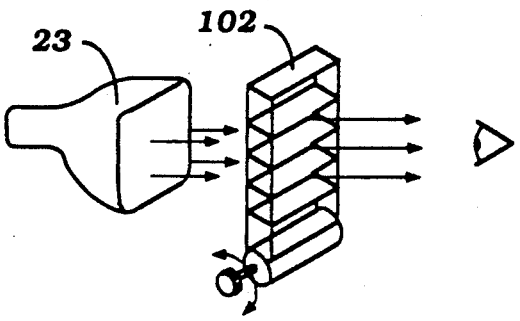
FIG. 8 is a schematic representation showing another modification of a display system.

FIG. 8 schematically illustrates another modification of the display system 22. A screen 102 is positioned in front of, or on, the displaying device 23 for easier viewing in sunny conditions. The screen 102 includes a manually operated knob for opening and closing the screen 102.

Figure 9:
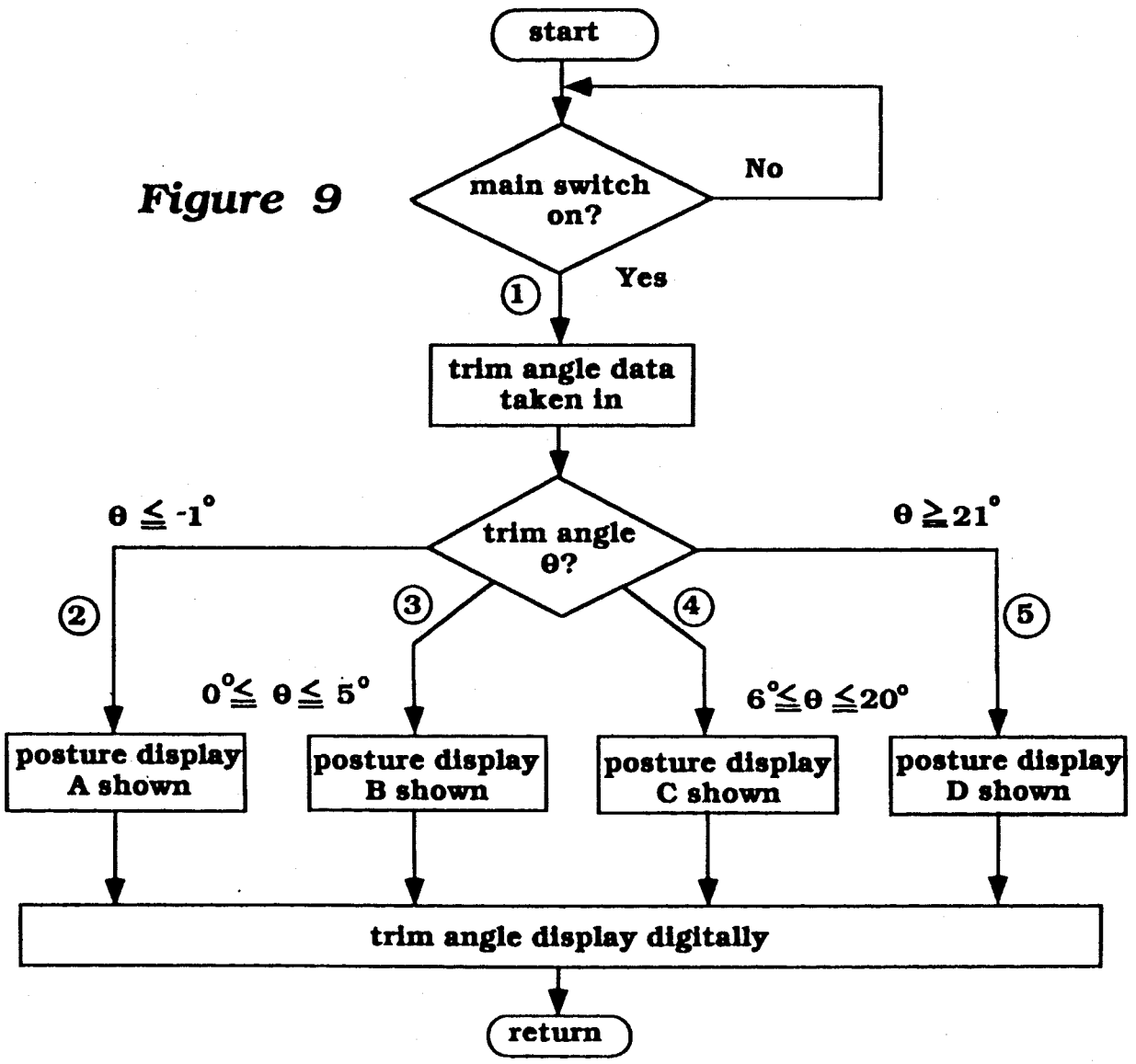
FIG. 9 is a flow chart showing the operation of the trim angle display, in accordance with an embodiment of the invention.

FIGS. 9 and 10 show by way of a flow chart and examples the operation of the trim angle information 38 of the variable display 25 or trim angle display which, as previously mentioned, can be separately installed and used, or can be incorporated into the variable display 25. In either case, the trim angle information or display 38 is preferably comprised of a graphical display 301 and a digital display 302 (see FIGS. 1 and 10). The operation of this trim angle display 38 is as follows:

If the main switch of the vessel 21 is on, the output of the trim angle sensor 55 is received by the processing unit 65 through the A/D converter 64.

Figure 10A:
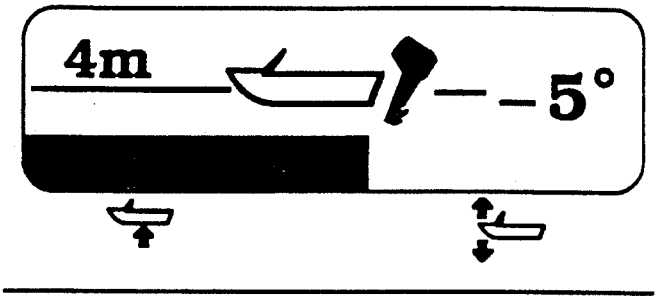
FIG. 10 is an illustration showing trim angle display examples.

When the detected trim angle is less than or equal to negative one degree, (−1°) the posture of the propulsion unit 20 is shown with a small negative inclination on the graphical display 301 and its trim angle is digitally shown on the digital display 302 (see FIG. 10(A)).

Figure 10B:
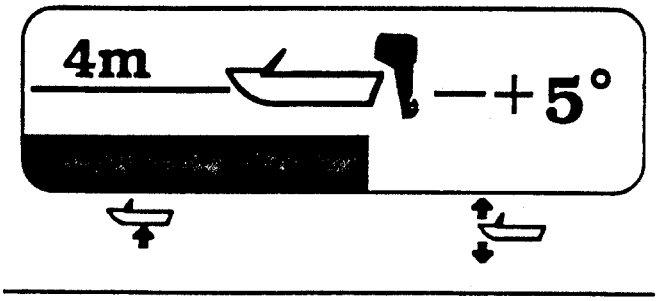
Figure 10C:
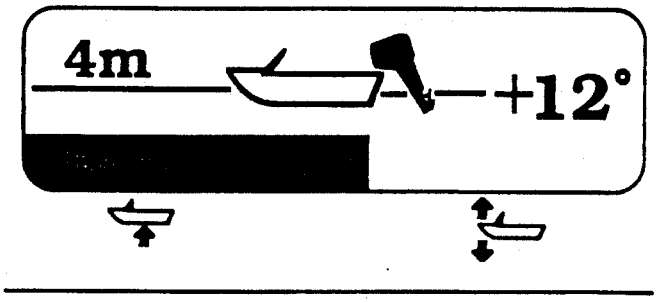

When the detected trim angle is greater than or equal to zero degrees (0°) but less than or equal to five degrees (5°), the posture of the propulsion unit 20 is shown with a small positive inclination on the graphical display 301 and its trim angle is digitally shown on the digital display 302 (see FIG. 10(B)). When the detected trim angle is greater than or equal to six degrees (6°) but less than or equal to twenty degrees (20°), the posture of the propulsion unit 20 is shown with a medium positive inclination on the graphical display 301 and its trim angle is digitally shown on the digital display 302 (see FIG. 10(C)).

Figure 10D:
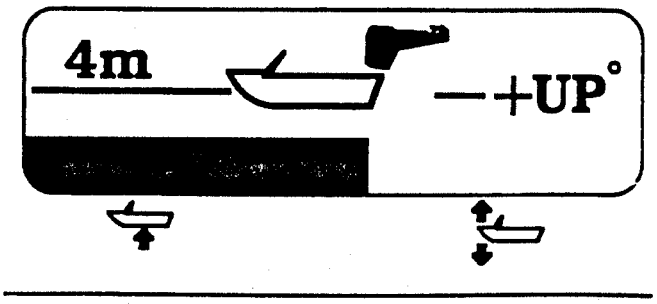

When the detected trim angle is greater than or equal to twenty one degrees (21°) the posture of the propulsion unit 20 is shown with a large positive inclination on the graphical display 310 and its trim angle is digitally shown on the digital display 302 (see FIG. 10(D)).

Figure 11:
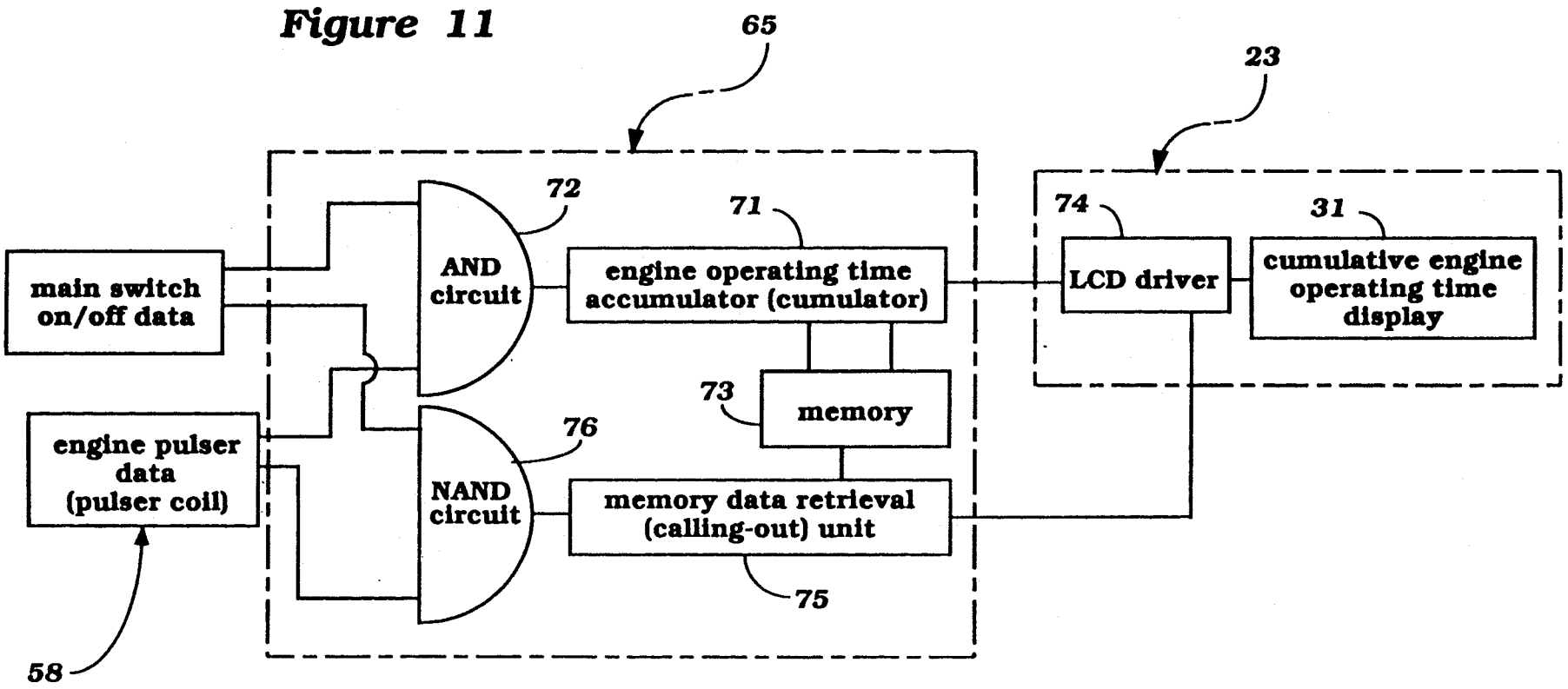
FIG. 11 is a block diagram showing an embodiment of the display system, including the components for detecting and displaying the cumulative engine operating time.

FIG. 11 shows the operation of the cumulative engine operating time display 31. When the engine is running, on-off data from the main switch used for turning on and off the variable display 25 and the pulse data generated by the engine charge or pulser coil 58 which constitutes the cumulative engine operating time sensor are transmitted to the processing unit 65. There, the output from the pulser coil 58 is transmitted to an engine operating time accumulator or cumulator 71 through an AND circuit or gate 72. The output of the accumulator or cumulator 71 (cumulated engine operating time) is then transmitted to a memory 73 where it is stored and to an LCD driver 74 for driving the fixed display 24 wherein cumulative engine operating time 31 is displayed.

When the engine is not running, on-off data from the main switch and the output from the pulser coil 58 are received by the processing unit 65 where they are transmitted to a memory data retrieval unit 75 through a NAND circuit or gate 76. Retrieval unit 75 retrieves or calls out the cumulative engine operating time stored in memory 73. That information is then transmitted to the LCD driver 74 for driving the fixed display 24 wherein cumulative engine operation time 31 is displayed.

Figure 12:
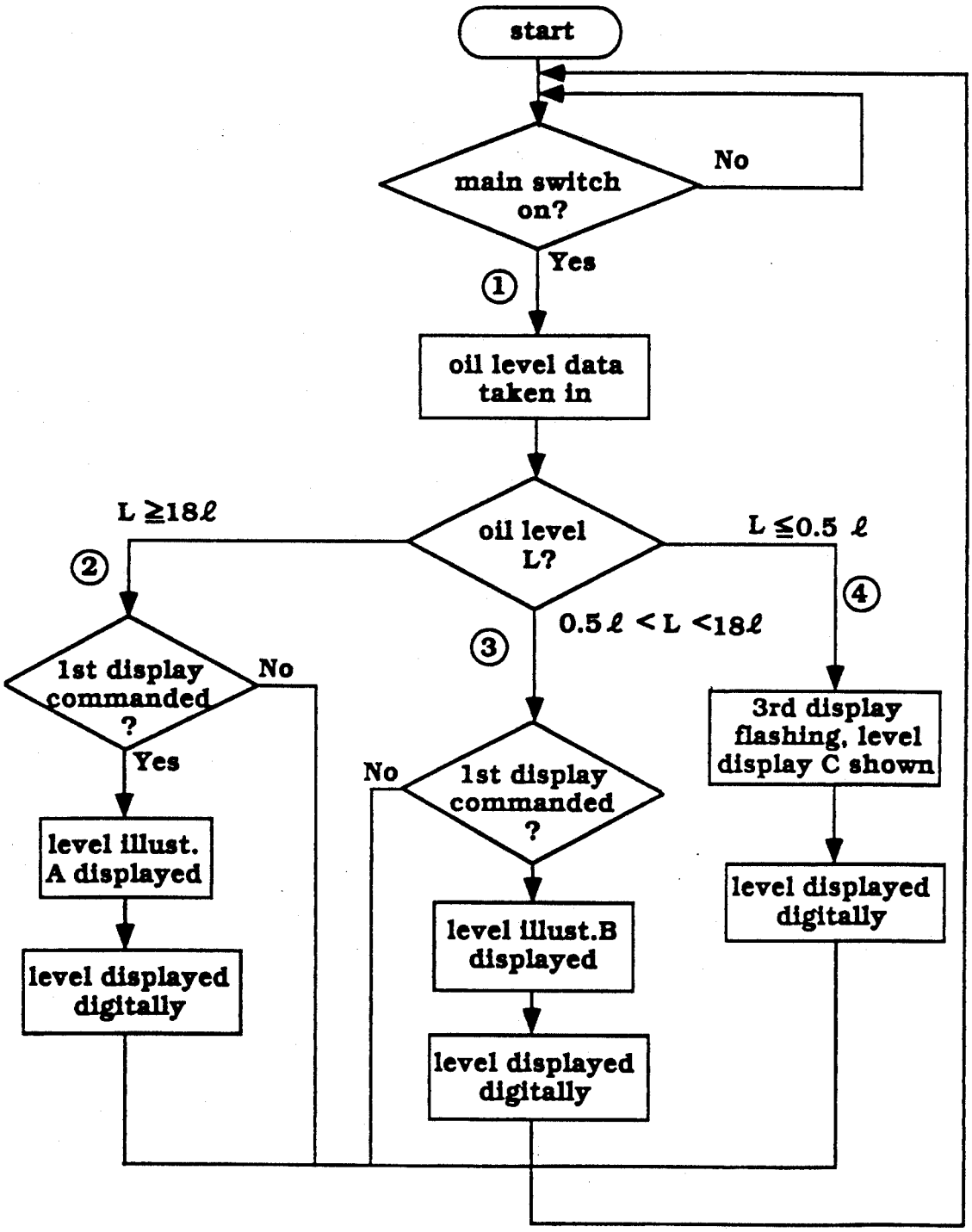
FIG. 12 is a flow chart showing the operation of an oil level display or the single displaying device as it pertains to oil level information.

FIG. 12 shows the operation of the oil level display 35 which is as follows:

If the main switch of the vessel 21 is on, the output of the oil level sensor 52 is received by the processing unit 65 through the A/D converter 64.

If the oil level is greater than or equal to 18 liters and the first display of information 26 is commanded, the oil level illustrated by letter A in FIG. 1 is shown on the graphical display 201 and the corresponding digital value for the oil level is shown in the digital display 202. If the first display is not commanded in this situation the program repeats.

If the oil level is greater than 0.5 liters but less than 18 liters and the first display is commanded, the oil level illustrated by letter B in FIG. 1 is shown on the graphical display 201 and the corresponding digital value for the oil level is shown on the digital display 202. As with the previous situation, if the first display is not commanded the program repeats.

If the oil level is less than or equal to 0.5 liters, the oil level warning 35A is automatically and flashingly displayed on the graphical display 201 of the warning display 28. The level shown is indicated by letter C in FIG. 1. The corresponding digital value for the oil level is shown on the digital display 202.

Although numerous embodiments of the invention have been illustrated and described, various changes and modifications may be made without departing from the spirit and scope of the invention, as defined by the appended claims.

What is claimed is:

1. In a marine vessel having a marine propulsion unit including an engine, the improvement comprising a display system, said display system comprising means for detecting the cumulative engine operating time, means for detecting a plurality of other operating and navigating conditions, a single displaying device comprising a variable display, and a cumulative engine operating time display for displaying the cumulative engine operating time, said single displaying device further displaying information regarding at least one of the plurality of other detected operating and navigating conditions, said display system further comprising a control device including an A/D converter, a processing unit which receives the output of said cumulative operating time detecting means, an LCD driver which receives the output of said processing unit, the output of said LCD driver being received by said cumulative engine operating time display, a main switch for turning on and off the variable display and wherein said processing unit further comprises an AND circuit, means for cumulating the cumulative engine operating time, and a memory, such that when the engine is running, on-off data from said switch and the output from said cumulative operating time detecting means are transmitted to said means for cumulating the cumulative engine operating time through said AND circuit, the output of said cumulating means being transmitted to said memory and to said LCD driver.

2. In a marine vessel as recited in claim 1, wherein said processing unit further comprises a NAND circuit and a memory data retrieval unit in circuit with said memory, such that when the engine is not running, on-off data from said switch and the output from said cumulative operating time detecting means are transmitted to said memory data retrieval unit through said NAND circuit, the output of said memory data retrieval unit being transmitted to said LCD driver.

3. In a marine vessel as recited in claim 2, wherein said means for detecting a plurality of other operating and navigating conditions includes a fuel level sensor, an engine speed sensor and a vessel speed sensor.

4. In a marine vessel as recited in claim 3, wherein said single displaying device displays information regarding a plurality of other detected operating and navigating conditions including fuel level, engine speed and vessel speed.

5. In a marine vessel as recited in claim 4, wherein said single displaying device further displays warning information regarding at least one of said plurality of other operating and navigating conditions when that particular condition is detected to be outside of a predetermined range for that particular condition.

6. In a marine vessel as recited in claim 5, wherein said single displaying device further comprises a fixed display for displaying information regarding particular operating and navigating conditions and a variable display having a first display of information, a second display of information and a warning display of warning information, the first and second displays being displayed alternately and the warning display of warning information regarding at least one of said plurality of operating and navigating conditions being displayed automatically when that particular condition is detected to be outside of its predetermined range.

7. In a marine vessel as recited in claim 6, wherein said display system further comprises a mode switch for alternately displaying the first and second displays of said variable display.

8. In a marine vessel as recited in claim 7, wherein said processing unit receives outputs from said means for detecting a plurality of other conditions through said converter and displays the outputs as information on said displaying device, said control device further including means for automatically displaying on said displaying device warning information regarding at least one of said plurality of operating and navigating conditions when that particular condition is detected to be outside of its predetermined range.

* * * * *